US006131536A

United States Patent [19]

Kujawa

[11] Patent Number: 6,131,536

[45] Date of Patent: Oct. 17, 2000

[54] INFRARED AND GAS FLUID HEATER SYSTEM

[76] Inventor: Stephen M. Kujawa, 90472 Sheffler Rd., Elmira, Oreg. 97437

[21] Appl. No.: 09/345,591

[22] Filed: Jun. 30, 1999

[51] Int. Cl.[7] ..... F22B 37/42; F22B 27/14

[52] U.S. Cl. ..... 122/14.22; 122/40; 122/448.3; 237/8 R

[58] Field of Search ..... 122/18, 24, 406.3, 122/447, 448.3, 451.1, 40; 236/20 R; 126/350 R, 351, 365; 392/450; 237/8 R, 8 A, 8 D, 19

[56] References Cited

U.S. PATENT DOCUMENTS 4,637,349 1/1987 Robinson ..... 122/448 B
4,638,944 1/1987 Kujawa et al. .
5,020,721 6/1991 Horne ..... 236/20 R
5,317,992 6/1994 Joyce ..... 126/350 R
5,494,003 2/1996 Bartz et al. ..... 122/17
5,511,570 4/1996 Noren et al. .
5,642,742 7/1997 Noren et al. .
5,881,952 3/1999 MacIntyre ..... 237/19

*Primary Examiner*—Stephen Gravini
*Assistant Examiner*—Gregory A. Wilson
*Attorney, Agent, or Firm*—Chernoff, Vilhauer, McClung & Stenzel

[57] ABSTRACT

An instantaneous fluid heating system includes a fluid source, a use point for intermittently demanding fluid from the fluid source, an instantaneous IR gas heater, and a temperature sensor positioned external to the heater. The instantaneous IR gas heater is interposed operatively between the fluid source and the use point. The temperature sensor controls the regulation of the heater in response to output fluid temperature.

7 Claims, 1 Drawing Sheet

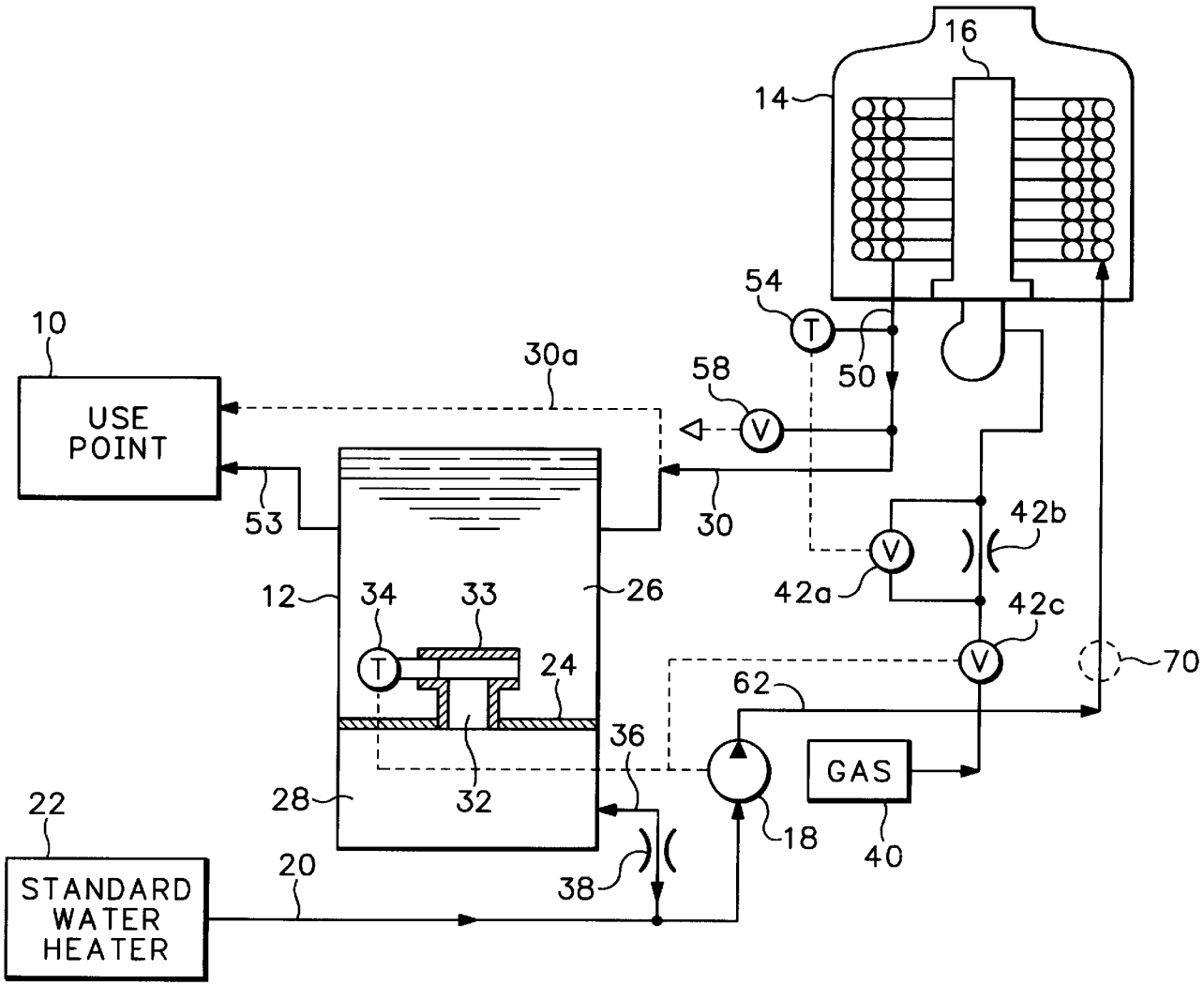
USE POINT
STANDARD WATER HEATER
GAS
10
12
14
16
18
20
22
24
26
28
30
30a
32
33
34
36
38
40
42a
42b
42c
50
53
54
58
62
70

INFRARED AND GAS FLUID HEATER SYSTEM

BACKGROUND OF THE INVENTION

The present invention relates to a fluid heater system, and particularly to a single tank fluid heater system with an exterior temperature sensor.

Instantaneous water heating systems have long been used in applications including, for example, dishwashing in commercial food establishments. There is a tight control window in which the water outlet temperature must be maintained in order to provide safe and consistent operation within a predetermined operating temperature range for a specific application. Maintaining the water outlet temperature within this tight control has been an ongoing problem for this type of heater.

U.S. Pat. No. 4,638,944 (the '944 patent), which is incorporated herein by reference, is directed to one solution to the temperature control problem. Specifically, the '944 patent addressed the problem of temperature control in a compact, high volume point of use instantaneous water heating system by using two individual water heaters, each with an "instantaneous" burner, heat exchanger, and an exterior temperature sensor. The burners of the instantaneous heaters would alternate between high and low heat asynchronously. The '944 system provides a consistently controlled outlet temperature by averaging four variables: the temperature within the lower portion of the accumulator tank measured by a thermostat therein; the temperature at the outlet of the first heat exchanger; the temperature at the outlet of the second heat exchanger; and the water flow through the entire unit.

The use of the dual heaters operating asynchronously as described in the '944 patent helped to permit the use of a smaller-sized accumulator tank adjacent the use point, since no large accumulator volume is required to smooth out water temperature fluctuations. However, to properly control temperatures, dual heaters were absolutely necessary because the burners known at that time were not capable of actual instantaneous heating requiring a short heat up time period. Further, the temperature sensors that existed at the time at which the '944 patent was applied for were neither quick nor accurate over time, resulting in poor reliability.

Although the '944 system contemplates a single auxiliary heater, the advantages associated with temperature control would be decreased, because the dual heaters are needed for averaging and accuracy.

What is needed, therefore, is a point of use instantaneous water heating system that is able to provide hot water on demand at a temperature within a predetermined tight control window.

BRIEF SUMMARY OF THE INVENTION

The present invention is directed to a heating system that takes advantage of the improvements in technology related to heaters and temperature sensors. Preferably, a single, quick, accurate external temperature sensor and a single, quick, accurate instantaneous heater, such as an IR gas burner, can be used to create a heater system that is more reliable, requires less field service, and has lower costs associated with parts, assembly, and calibration than previously known systems. The heating system of the present invention also eliminates the need for averaging variables to control output temperature.

Specifically, a fluid heating system of the present invention preferably includes a fluid source, a use point for intermittently demanding fluid from the fluid source, at least one instantaneous IR gas heater, and a temperature sensor positioned external to the heater. The instantaneous IR gas heater is preferably interposed operatively between the fluid source and the use point for heating fluid from the fluid source instantaneously and delivering fluid substantially immediately after heating to the use point during periods of demand. The temperature sensor preferably controls the regulation of the heater in response to output fluid temperature.

The foregoing and other objectives, features, and advantages of the invention will be more readily understood upon consideration of the following detailed description of the invention, taken in conjunction with the accompanying drawings.

BRIEF DESCRIPTION OF THE DRAWING

The single FIGURE is a schematic diagram of an exemplary point of use instantaneous water heating system constructed according to the present invention.

DETAILED DESCRIPTION OF THE PREFERRED EMBODIMENT

The water heating system of the present invention provides hot water to a use point 10 from a relatively small accumulator tank 12. The accumulator tank 12 is fed by an ancillary, high-energy instantaneous water heater 14 heated by an internal IR gas burner 16. The IR gas burner 16 may be a ceramic fiber type as provided by Solaronics, Inc. or another suitable IR gas burner. Water is provided to the ancillary water heater by one or more pressure boosting pumps such as pump 18, connected to a water input line 20 leading from a standard hot water heater 22 which is a source of water for the system. Water is also recirculated from the accumulator 12 through line 36 and pump 18 to the heater.

The accumulator tank 12 includes an interior baffle 24 which is a wall or partition separating a top portion 26 of the accumulator tank 12 from a bottom portion 28. The baffle 24 will create temperature stratification of the water held within the accumulator tank 12. In general, the hotter water which is fed to the accumulator tank from the heater 14 through line 30 will be concentrated in the top portion of the tank 26, whereas the bottom portion of the tank 28 will be a zone of relatively low temperature (although it will normally be hotter than water from the standard water heater 22). This would normally be the case even without the baffle 24 since the hotter water tends to rise to the top; however, the baffle 24 increases the degree of stratification of the water temperature, creating two distinct zones instead of a gradual temperature gradient and reducing thermosyphon currents which tend to equalize tank temperatures. The baffle 24 has an aperture 32 which allows fluid communication through a tee fitting 33 between the top portion 26 and the bottom portion 28. Disposed close to the aperture 32 is a conventional microprocessor-controlled thermostat 34. Thermostat 34, which may be either above or below the baffle 24, controls the operation of pump 18. The accumulator tank recirculation line 62 leads from the zone of relatively low temperature in the bottom portion 28 of the accumulator to the water input line 20 through an optional restriction 38 or similar valving arrangement.

The heater 14 is heated by an IR gas burner 16 located within 9 heat exchanger. The IR gas burner 16 receives gas from gas source 40 of natural gas, LPG, or LNG. Gas source 40 is controlled by respective modulating valve arrangements consisting of a valve 42*a* and a restriction 46*b*, as well as by the primary valve 42*c*. The primary valve 42*c* is controlled in response to a decreased temperature in the accumulator sensed by thermostat 34. The modulating valve 42*a* is controlled by temperature sensor 54 located immediately external to the heater at the output 50 of the heater, and modulates the gas supply by opening in response to output water temperature decreasing below a predetermined limit, and closing in response to output water temperature increasing above a predetermined limit. When the modulating valve 42*a* is closed, a reduced flow of gas is permitted through restriction 42*b*. Thermostat 34 deactivates the pump 18 in response to sufficiently high water temperature sensed at the accumulator thermostat 34, and also deactivates heater 14 by closing primary valve 42*c*. The heater also includes a conventional pressure and temperature safety relief valve 58 which may be located in the heater output line 30 and/or the accumulator tank 12.

There are two fundamental modes of operation of the system. In both cases, however, it is important that water at a predetermined temperature be available for instantaneous use at the use point 10. In the first mode of operation, which may be termed the "no-demand" mode, there is little or no demand at the use point 10 and the system must, by recirculation, maintain the temperature of the water in the accumulator tank 12 so as to be ready for instantaneous use. In the second, or "demand," mode of operation there is constant or intermittent demand at the use point 10, and there is little or no recirculation in the accumulator tank 12.

In either case, the thermostat 34 is set to actuate pump 18 at a predetermined minimum temperature lower than the desired temperature of the water to be delivered to the use point 10. This is because of the low position of the thermostat 34 in the tank and the fact that there will always be stratification of the temperature of the water held within the accumulator tank. When the thermostat 34 senses the accumulator water temperature dropping below the predetermined minimum, either due to normal accumulator heat loss or due to demand at the use point 10 while the pump 18 is deactivated (the latter drawing cooler water into the bottom of the accumulator through recirculation conduit 36 while hot water is discharged to the use point from the top of the accumulator through pipe 53), it actuates pump 18. The pump draws water from either recirculation line 36 or input line 20, or a combination of both, depending upon water pressure in and flow through the tank 12 (which in turn depends on the presence or absence of demand at the use point). Restriction 38 serves to create priority of flow from the standard water heater 22 over that recirculating from the tank 12. However, during periods of no demand when the pump 18 is activated, the pressure in line 36, even with restriction 38, will be higher than the pressure in line 20, and therefore the pump 18 will draw water from recirculation line 36. On the other hand, in the "demand" mode the pressure in the tank 12 will not normally be enough to override the pressure from the standard water heater 22, and water will be drawn from the standard heater 22 until demand ceases. This priority arrangement, the placement and setting of the thermostat 34, and the baffle 24, all contribute toward insuring that the heater 14 always receives the lowest temperature water available so as to minimize the danger of super heating.

When pump 18 is actuated by thermostat 34, water is pumped into line 62. Gas ignition control is energized and valve 42*c* is opened, providing gas for ignition. Thereafter gas flow is modulated by valve 42*a* in response to heater output temperature sensor 54 to maintain the output temperatures from the heater within the desired range. Water is pumped into heater 14 by pump 18 where it is heated substantially instantaneously by IR gas burner 16, and is then supplied through heater output line 50 to the water input line 30 of accumulator tank 12. In the "no demand" mode, the heated water is stored in the tank 12, replacing cooler water recirculated back to the heater 14 through line 36. In contrast, in the "demand" mode, the heated water is immediately transferred to the use point 10 through line 53 due to its proximity to the line 30. (In the demand mode, the water could alternatively be transferred directly through a line such as 30*a*, bypassing the accumulator tank 12 and rendering line 53 unnecessary.)

One of the crucial features of the water heating system of the present invention is the accuracy of the temperature control. Accordingly, like thermostat 34, output temperature sensor 54 is a conventional micro-processor controlled thermostat. Using a single external output temperature sensor has many advantages. Specifically, the more reliable temperature sensor allows valve 42*a* to cycle much more rapidly, providing closer temperature control comparable to that obtainable from the rapidly cycling IR gas burner 16. Moreover, the temperature sensor requires less field service, and has lower costs associated with parts, assembly, and calibration.

It should be noted that the system described above with a single ancillary water heater may be fitted with one or more additional ancillary water heaters. If two water heaters are used, the dual ancillary water heaters would function in much the same manner as the dual water heaters described in the '944 patent, the disclosure of which is incorporated herein by reference.

The system described above utilizes water as the fluid to be used at the use point 10. However, this system may be used for any fluid which may have to be heated and made available for instantaneous use, and is therefore not limited to applications calling for water.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims that follow.

What is claimed is:

1. An instantaneous fluid heating system comprising:

(a) a fluid source;

(b) an intermittent use point for fluid from said source;

(c) an accumulator tank having at least one accumulator tank inlet and at least one accumulator tank outlet, said accumulator tank being in communication with said use point through said at least one accumulator tank outlet;

(d) a fluid heater, having a fluid inlet and a fluid outlet, interposed operably between said fluid source and said at least one accumulator tank inlet;

(e) an infrared gas burner associated with said heater; and (f) a fluid temperature sensor sensitive to fluid temperature at said fluid outlet of said heater, said infrared gas burner being controllably connected to said temperature sensor;

(g) said fluid heating system having only a single said heater.

2. The fluid heating system of claim 1 having only a single said temperature sensor.

3. The fluid heating system of claim 1 wherein said accumulator tank includes a recirculation conduit connected to said fluid inlet of said heater.

4. An instantaneous fluid heating system comprising:

(a) a fluid source;

(b) an intermittent use point for fluid from said source;

(c) a fluid heater, having a fluid inlet and a fluid outlet, interposed operably between said fluid source and said use point;

(d) an infrared gas burner associated with said heater; and (e) a fluid temperature sensor sensitive to fluid temperature at said fluid outlet, said infrared gas burner being controllably connected to said temperature sensor;

(f) said fluid heating system having only a single said heater.

5. The fluid heating system of claim 4 having only a single said temperature sensor.

6. The fluid heating system of claim 4 further comprising an accumulator tank selectively operatively interposed between said fluid outlet of said heater and said use point.

7. The fluid heating system of claim 6 wherein said accumulator tank includes a recirculation conduit connected to said fluid inlet of said heater.

* * * * *